US012638231B2

(12) United States Patent
Rhie et al.

(10) Patent No.: US 12,638,231 B2
(45) Date of Patent: May 26, 2026

(54) REFRIGERATOR

(71) Applicant: SAMSUNG ELECTRONICS CO., LTD., Suwon-si (KR)

(72) Inventors: Jisu Rhie, Suwon-si (KR); Youngil Song, Suwon-si (KR); Hyeonuk Seong, Suwon-si (KR); Minseob Yook, Suwon-si (KR); Jaejin Lee, Suwon-si (KR); Byoungjae Cho, Suwon-si (KR); Yongman Seo, Suwon-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 153 days.

(21) Appl. No.: 18/756,020

(22) Filed: Jun. 27, 2024

(65) Prior Publication Data

US 2025/0075966 A1 Mar. 6, 2025

Related U.S. Application Data

(63) Continuation of application No. PCT/KR2024/008630, filed on Jun. 21, 2024.

(30) Foreign Application Priority Data

Aug. 30, 2023 (KR) ..... 10-2023-0114982
Jan. 5, 2024 (KR) ..... 10-2024-0002525

(51) Int. Cl.
*F25D 23/02* (2006.01)

(52) U.S. Cl.
CPC ..... *F25D 23/028* (2013.01); *F25D 2700/06* (2013.01)

(58) Field of Classification Search
None
See application file for complete search history.

(56) References Cited

U.S. PATENT DOCUMENTS 9,528,756 B2 * 12/2016 Kim ..... H04N 23/54
10,024,594 B2 * 7/2018 Staedel ..... F25D 25/02
(Continued)

FOREIGN PATENT DOCUMENTS

CN 207351036 U 5/2018
CN 109631456 A * 4/2019 ..... F25D 23/02
(Continued)

OTHER PUBLICATIONS

International Search Report dated Oct. 16, 2024 issued in PCT Application No. PCT/KR2024/008630.
(Continued)

*Primary Examiner* — Hanh V Tran
(74) *Attorney, Agent, or Firm* — STAAS & HALSEY LLP

(57) ABSTRACT

A refrigerator including a cabinet; a storage compartment in the cabinet; a door coupled to the cabinet to open and close the storage compartment; an upper table on an upper surface of the cabinet and having a mounting hole on a front surface of the upper table; a bracket mounted on the upper table and including a protruding portion, and an inclined portion at a lower portion of the protruding portion and including an opening; and a camera mounted on the bracket. The bracket and the camera are configured so that the protruding portion accommodates the camera and protrudes through the mounting hole and outside the upper table, the lens of the camera is exposed through the opening of the inclined portion, and the inclined portion is inclined so that an image captured by the camera includes an area outside the storage compartment and an area inside the storage compartment.

11 Claims, 19 Drawing Sheets

(56) References Cited

U.S. PATENT DOCUMENTS

| | | | | |
|---|---|---|---|---|
| 10,365,034 | B2 * | 7/2019 | Kang | F25D 29/00 |
| 10,926,716 | B2 * | 2/2021 | Wuertemberger | H04N 23/57 |
| 11,441,837 | B2 | 9/2022 | Du et al. | |
| 12,442,584 | B2 * | 10/2025 | Kang | G06Q 30/0601 |
| 2016/0021342 | A1 * | 1/2016 | Aso | H04N 7/183 702/150 |
| 2020/0173717 | A1 * | 6/2020 | Du | F25D 23/06 |
| 2024/0095674 | A1 * | 3/2024 | Suda | G06Q 10/087 |
| 2024/0135715 | A1 * | 4/2024 | Mochinaga | G06V 10/235 |

FOREIGN PATENT DOCUMENTS

| | | | | | |
|---|---|---|---|---|---|
| CN | 110873510 | A | * | 3/2020 | F25D 29/005 |
| CN | 216977312 | U | | 7/2022 | |
| CN | 111238115 | B | | 9/2022 | |
| CN | 118670061 | A | * | 9/2024 | F25D 29/005 |
| JP | 5918210 | B2 | * | 5/2016 | |
| JP | 2021-196069 | | | 12/2021 | |
| JP | 2022-94416 | | | 6/2022 | |
| JP | 7137369 | | | 9/2022 | |
| JP | 2022-167526 | | | 11/2022 | |
| JP | 7297563 | | | 6/2023 | |
| KR | 10-2018-0013448 | | | 2/2018 | |
| KR | 20180013448 | A | * | 2/2018 | F25D 29/00 |
| KR | 10-2022-0030128 | | | 3/2022 | |
| KR | 10-2022-0075302 | | | 6/2022 | |
| KR | 20240175151 | A | * | 12/2024 | G03B 17/55 |
| TW | 202314174 | A | * | 4/2023 | F25D 29/00 |
| WO | WO-2021112409 | A1 | * | 6/2021 | G06Q 10/087 |
| WO | WO-2022038799 | A1 | * | 2/2022 | F25D 13/04 |

OTHER PUBLICATIONS

Written Opinion dated Oct. 16, 2024 issued in PCT Application No. PCT/KR2024/008630.

* cited by examiner

REFRIGERATOR

CROSS-REFERENCE TO RELATED APPLICATIONS

This application is a continuation application, under 35 U.S.C. § 111(a), of International Application No. PCT/KR2024/008630, filed on Jun. 21, 2024, which claims priority under 35 U.S.C. § 119 to Korean Patent Application No. 10-2023-0114982, filed Aug. 30, 2023, and Korean Patent Application No. 10-2024-0002525, filed Jan. 5, 2024, in the Korean Intellectual Property Office, the disclosures of which are incorporated by reference herein in their entireties.

TECHNICAL FIELD

The disclosure relates to a refrigerator in which a camera may be installed to record putting in and taking out food without deforming the door.

BACKGROUND ART

In general, a refrigerator, an appliance for keeping food fresh, includes a main body having a storage compartment and a cold air supply device for supplying cold air to the storage compartment. The storage compartment includes a refrigerating compartment in which the food is kept refrigerated at a temperature of about 0° C. to 5° C., and a freezing compartment in which the food is kept frozen at a temperature of about 0° C. to −30° C. A door is provided on a front surface of the main body to open or close the storage compartment. The door is rotatably provided on the front surface of the main body to open or close the storage compartment.

Conventional refrigerators may simply perform the function of storing food at a low temperature. In recent years, however, the need for additional functions other than food storage has increased.

Refrigerators are usually food storage appliances, and food may be placed in the storage compartment to be stored or taken out of the storage compartment to be used. Users may install a camera in the refrigerator to record when food is put in and taken out.

DISCLOSURE

Technical Problem

The present disclosure is directed to a refrigerator in which a camera may be installed to capture the insertion and removal of food without deforming the door.

Further, the present disclosure is directed to a refrigerator capable of capturing images of the outside and inside of the storage compartment.

Further, the present disclosure is directed to a refrigerator capable of preventing water and/or dust from entering a lens of a camera that takes pictures of the outside and inside of the storage compartment.

Further, the present disclosure is directed to a refrigerator capable of preventing movement of a camera device.

Technical tasks to be achieved in this document are not limited to the technical tasks mentioned above, and other technical tasks not mentioned will be clearly understood by those skilled in the art from the description below.

Technical Solution

Aspects of embodiments of the disclosure will be set forth in part in the description which follows and, in part, will be apparent from the description, or may be learned by practice of the present embodiments.

According to an embodiment of the disclosure, a refrigerator includes a cabinet; a storage compartment in the cabinet; a door coupled to the cabinet so as to be rotatable to open and close the storage compartment; an upper table on an upper surface of the cabinet and having a mounting hole formed on a front surface of the upper table; a bracket mounted on the upper table and including a protruding portion, and an inclined portion at a lower portion of the protruding portion and including an opening; and a camera mounted on the bracket and including a lens; wherein the bracket and the camera are configured so that the protruding portion accommodates the camera and protrudes through the mounting hole and outside the upper table by a length less than a gap between the front surface of the upper table and the door, the lens of the camera is exposed through the opening of the inclined portion, and the inclined portion is inclined so that an image captured by the camera includes an area outside the storage compartment and an area inside the storage compartment.

According to an embodiment of the disclosure, the door may include a gasket on a rear surface of the door to be in contact with the cabinet while the door is closed. The gap between the front surface of the upper table and the door may be equal to a thickness of the gasket.

According to an embodiment of the disclosure, the door may include a first door coupled to a left side of the cabinet so as to be rotatable to open and close the storage compartment, and a second door coupled to a right side of the cabinet so as to be rotatable to open and close the storage compartment. While the first door and the second door are rotated so that the storage compartment is closed, the camera may be accommodated in the bracket at a position between the first door and the second door.

According to an embodiment of the disclosure, the refrigerator may further include a controller mounted on the bracket to control an operation of the camera.

According to an embodiment of the disclosure, the refrigerator may further include a light emitting diode (LED) indicator mounted on the bracket to provide an external confirmation that the camera is operational while the camera is activated by the controller.

According to an embodiment of the disclosure, the gap between the front surface of the upper table and the door may be 10 mm. The protruding portion may protrude less than 10 mm from the front surface of the upper table to prevent collision with the door.

According to an embodiment of the disclosure, the bracket may include a pair of first coupling holes through which screws are received to couple the bracket to the upper table.

According to an embodiment of the disclosure, the upper table may include a pair of second coupling holes in which the screws received through the pair of first coupling holes are respectively received.

According to an embodiment of the disclosure, the upper table may include a pair of support ribs respectively formed by the pair of second coupling holes and configured to support the bracket while the bracket is coupled to the upper table.

According to an embodiment of the disclosure, the bracket may include a plurality of anti-movement ribs in contact with the upper table, the plurality of anti-movement ribs preventing the bracket from being moved during opening and closing of the door.

According to an embodiment of the disclosure, a diameter of the opening may be 0.1 mm larger than a diameter of the lens.

Further, according to an embodiment of the present disclosure, a refrigerator includes a cabinet, a storage compartment in the cabinet, a door rotatably coupled to the cabinet to open or close the storage compartment, an upper table on an upper surface of the cabinet and having a mounting hole formed on a front surface thereof, and a camera device mountable on the upper table to capture the outside and inside of the storage compartment. The camera device includes a camera to capture the outside and inside of the storage compartment, a bracket mountable on the upper table and including a protruding portion protruding outwardly from the upper table through the mounting hole so that the camera captures the outside of the storage compartment and the camera and an inclined portion formed to be inclined at a lower portion of the protruding portion to capture the inside of the storage compartment, and a controller mountable on the bracket to control an operation of the camera.

DESCRIPTION OF DRAWINGS

These and/or other aspects of the disclosure will become apparent and more readily appreciated from the following description of embodiments, taken in conjunction with the accompanying drawings of which.

MODES OF THE INVENTION

Figure 1:
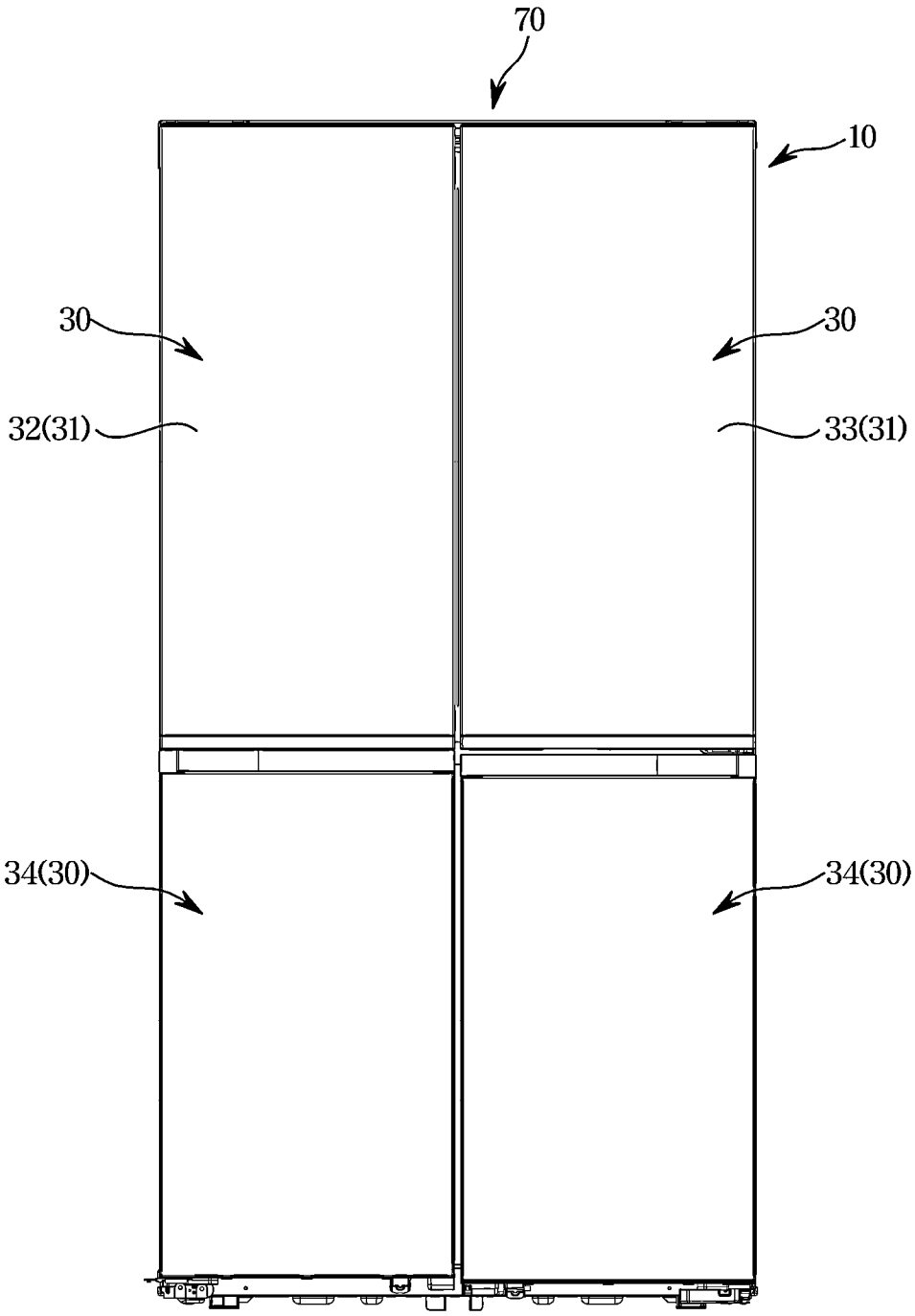
FIG. 1 is a view illustrating the front of a refrigerator according to an embodiment.

Various embodiments of the present document and terms used therein are not intended to limit the technical features described in this document to specific embodiments, and should be understood to include various modifications, equivalents, or substitutes of the corresponding embodiments.

In connection with the description of the drawings, similar reference numerals may be used for similar or related components.

The singular form of a noun corresponding to an item may include one or a plurality of the items unless clearly indicated otherwise in a related context.

In this document, phrases, such as "A or B", "at least one of A and B", "at least one of A or B," "A, B or C," "at least one of A, B and C," and "at least one of A, B, or C", may include any one or all possible combinations of items listed together in the corresponding phrase among the phrases.

As used herein, the term "and/or" includes any and all combinations of one or more of associated listed items.

Terms such as "1st", "2nd", "primary" or "secondary" may be used simply to distinguish a component from other components, without limiting the component in other aspects (e.g., importance or order).

Further, as used in the disclosure, the terms "front", "rear", "top", "bottom", "side", "left", "right", "upper", "lower", and the like are defined with reference to the drawings, and are not intended to limit the shape and position of each component.

When a component (e.g., a first component) is referred to as "coupled" or "connected" to another component (e.g., a second component), with or without the terms "functionally" or "communicatively," it may refer to that the component may be connected to another component directly (e.g., wired), wirelessly, or through a third component.

It will be understood that when the terms "includes," "comprises," "including," and/or "comprising," when used in this specification, specify the presence of stated features, figures, steps, operations, components, members, or combinations thereof, but do not preclude the presence or addition of one or more other features, figures, steps, operations, components, members, or combinations thereof.

It will be understood that when a certain component is referred to as being "connected to", "coupled to", "supported by" or "in contact with" another component, it can be directly or indirectly connected to, coupled to, supported by, or in contact with the other component. When a component is indirectly connected to, coupled to, supported by, or in contact with another component, it may be connected to, coupled to, supported by, or in contact with the other component through a third component.

It will also be understood that when a component is referred to as being "on" or "over" another component, it can be directly on the other component or intervening components may also be present.

A refrigerator according to an embodiment of the disclosure may include a main body.

The "main body" may include an inner case, an outer case positioned outside the inner case, and an insulation provided between the inner case and the outer case.

The "inner case" may include a case, a plate, a panel, or a liner forming a storage compartment (also referred to as a storage room). The inner case may be formed as one body, or may be formed by assembling a plurality of plates together. The "outer case" may form an appearance of the main body, and be coupled to an outer side of the inner case such that the insulation is positioned between the inner case and the outer case.

The "insulation" may insulate inside of the storage compartment from outside of the storage compartment to maintain inside temperature of the storage compartment at appropriate temperature without being influenced by an external environment of the storage compartment. According to an embodiment of the disclosure, the insulation may include a foaming insulation. The foaming insulation may be molded by fixing the inner case and the outer case with jigs, etc. and then injecting and foaming urethane foam as a mixture of polyurethane and a foaming agent between the inner case and the outer case.

According to an embodiment of the disclosure, the insulation may include a vacuum insulation in addition to a foaming insulation, or may be configured only with a vacuum insulation instead of a forming insulation. The vacuum insulation may include a core material and a cladding material accommodating the core material and sealing the inside with vacuum or pressure close to vacuum. The vacuum insulation may further include an adsorbent for adsorbing a gas and water to stably maintain a vacuum state. However, the insulation is not limited to the above-mentioned foaming insulation or vacuum insulation, and may include various materials capable of being used for insulation.

The refrigerator according to an embodiment of the disclosure may include the storage compartment provided inside the main body to store food.

The "storage compartment" may include a space defined by the inner case. The storage compartment may further include the inner case defining the space. One side of the storage compartment may open to enable a user to put food in or take food out. The storage compartment may store "food" therein. The food may include victual which humans eat and drink, and specifically, the food may include meat, fish, seafood, fruits, vegetables, water, ice, drinks, kimchi, alcoholic beverages such as wine, etc. However, medicines or cosmetics, as well as food, may be stored in the storage compartment, and goods that may be stored in the storage compartment are not limited.

The refrigerator may include one or more storage compartments. In a case in which two or more storage compartments are formed in the refrigerator, the respective storage compartments may have different purposes of use, and may be maintained at different temperature. To this end, the storage compartments may be partitioned by a partition wall including an insulation. According to an embodiment of the disclosure, the partition may be one portion of the main body. According to an embodiment of the disclosure, the partition may be provided independently from the main body and then assembled into the main body.

The storage compartment may be maintained within an appropriate temperature range according to a purpose of use, and include a "refrigerating compartment", a "freezing compartment", and a "temperature conversion compartment" according to purposes of use and/or temperature ranges. The refrigerating compartment may be maintained at appropriate temperature to keep food refrigerating, and the freezing compartment may be maintained at appropriate temperature to keep food frozen. The "refrigerating" may be keeping food cold without freezing the food, and for example, the refrigerating compartment may be maintained within a range of 0 degrees Celsius to 7 degrees Celsius. The "freezing" may be freezing food or keeping food frozen, and for example, the freezing compartment may be maintained within a range of −20 degrees Celsius to −1 degrees Celsius. The temperature conversion compartment may be used as any one of a refrigerating compartment or a freezing compartment according to or regardless of a user's selection. According to an embodiment of the disclosure, an area of the storage compartment may be used as a refrigerating compartment and the remaining area of the storage compartment may be used as a freezing compartment.

The storage compartment may also be called various other terms, such as "vegetable compartment (also referred to room)", "freshness compartment", "cooling compartment", and "ice-making compartment", in addition to "refrigerating compartment", "freezing compartment", and "temperature conversion compartment", and the terms, such as "refrigerating compartment", "freezing compartment", "temperature conversion compartment", etc., as used below need to be understood to represent storage compartments having the corresponding purposes of use and the corresponding temperature ranges.

The refrigerator according to an embodiment of the disclosure may include at least one door configured to open or close the open side of the storage compartment. The respective doors may be provided to open and close one or more storage compartments, or a single door may be provided to open and close a plurality of storage compartments. The door may be rotatably or slidably mounted on the front of the main body.

The "door" may seal the storage compartment in a closed state. The door may include an insulation, like the main body, to insulate the storage compartment in the closed state.

According to an embodiment, the door may include an outer door plate forming the front surface of the door, an inner door plate forming the rear surface of the door and facing the storage compartment, an upper cap, a lower cap, and a door insulation provided therein.

A gasket may be provided on the edge of the inner door plate to seal the storage compartment by coming into close contact with the front surface of the main body when the door is closed. The inner door plate may include a dyke that protrudes rearward to allow a door basket for storing items to be fitted.

According to an embodiment, the door may include a door body and a front panel that is detachably coupled to the front of the door body and forms the front surface of the door. The door body may include an outer door plate that forms the front surface of the door body, an inner door plate that forms the rear surface of the door body and faces the storage compartment, an upper cap, a lower cap, and a door insulator provided therein.

The refrigerator may be classified as French Door Type, Side-by-side Type, Bottom Mounted Freezer (BMF), Top Mounted Freezer (TMF), or One Door Refrigerator depending on the arrangement of the doors and the storage compartments.

The refrigerator according to an embodiment of the disclosure may include a cold air supply device for supplying cold air to the storage compartment.

The "cold air supply device" may include a machine, an apparatus, an electronic device, and/or a combination system thereof, capable of generating cold air and guiding the cool air to cool the storage compartment.

According to an embodiment of the disclosure, the cold air supply device may generate cold air through a cooling cycle including compression, condensation, expansion, and evaporation processes of refrigerants. To this end, the cold air supply device may include a cooling cycle device having a compressor, a condenser, an expander, and an evaporator to drive the cooling cycle. According to an embodiment of the disclosure, the cold air supply device may include a semiconductor such as a thermoelectric element. The thermoelectric element may cool the storage compartment by heating and cooling actions through the Peltier effect.

The refrigerator according to an embodiment of the disclosure may include a machine compartment where at least some components belonging to the cold air supply device are installed.

The "machine compartment" may be partitioned and insulated from the storage compartment to prevent heat generated from the components installed in the machine compartment from being transferred to the storage compartment. To dissipate heat from the components installed inside the machine compartment, the machine compartment may communicate with outside of the main body.

The refrigerator according to an embodiment of the disclosure may include a dispenser provided on the door to provide water and/or ice. The dispenser may be provided on the door to allow access by the user without opening the door.

The refrigerator according to an embodiment of the disclosure may include an ice-making device that produces ice. The ice-making device may include an ice-making tray that stores water, an ice-moving device that separates ice from the ice-making tray, and an ice-bucket that stores ice generated in the ice-making tray.

The refrigerator according to an embodiment of the disclosure may include a controller for controlling the refrigerator.

The "controller" may include a memory for storing and/or memorizing data and/or programs for controlling the refrigerator, and a processor for outputting control signals for controlling the cold air supply device, etc. according to the programs and/or data memorized in the memory.

The memory may store or record various information, data, commands, programs, and the like necessary for operations of the refrigerator. The memory may store temporary data generated while generating control signals for controlling components included in the refrigerator. The memory may include at least one of volatile memory or non-volatile memory, or a combination thereof.

The processor may control the overall operation of the refrigerator. The processor may control the components of the refrigerator by executing programs stored in memory. The processor may include a separate neural processing unit (NPU) that performs an operation of an artificial intelligence (AI) model. In addition, the processor may include a central processing unit (CPU), a graphics processor (GPU), and the like. The processor may generate a control signal to control the operation of the cold air supply device. For example, the processor may receive temperature information of the storage compartment from a temperature sensor, and generate a cooling control signal for controlling an operation of the cold air supply device based on the temperature information of the storage compartment.

Furthermore, the processor may process a user input of a user interface and control an operation of the user interface according to the programs and/or data memorized/stored in the memory. The user interface may be provided using an input interface and an output interface. The processor may receive the user input from the user interface. In addition, the processor may transmit a display control signal and image data for displaying an image on the user interface to the user interface in response to the user input.

The processor and memory may be provided integrally or may be provided separately. The processor may include one or more processors. For example, the processor may include a main processor and at least one sub-processor. The memory may include one or more memories.

The refrigerator according to an embodiment of the disclosure may include a processor and a memory for controlling all the components included in the refrigerator, and may include a plurality of processors and a plurality of memories for individually controlling the components of the refrigerator. For example, the refrigerator may include a processor and a memory for controlling the operation of the cold air supply device according to an output of the temperature sensor. In addition, the refrigerator may be separately equipped with a processor and a memory for controlling the operation of the user interface according to the user input.

A communication module may communicate with external devices, such as servers, mobile devices, and other home appliances via a nearby access point (AP). The AP may connect a local area network (LAN) to which a refrigerator or a user device is connected to a wide area network (WAN) to which a server is connected. The refrigerator or the user device may be connected to the server via the WAN.

The input interface may include keys, a touch screen, a microphone, and the like. The input interface may receive the user input and pass the received user input to the processor.

The output interface may include a display, a speaker, and the like. The output interface may output various notifications, messages, information, and the like generated by the processor.

Hereinafter, various embodiments according to the disclosure will be described in detail with reference to the accompanying drawings.

Figure 2:
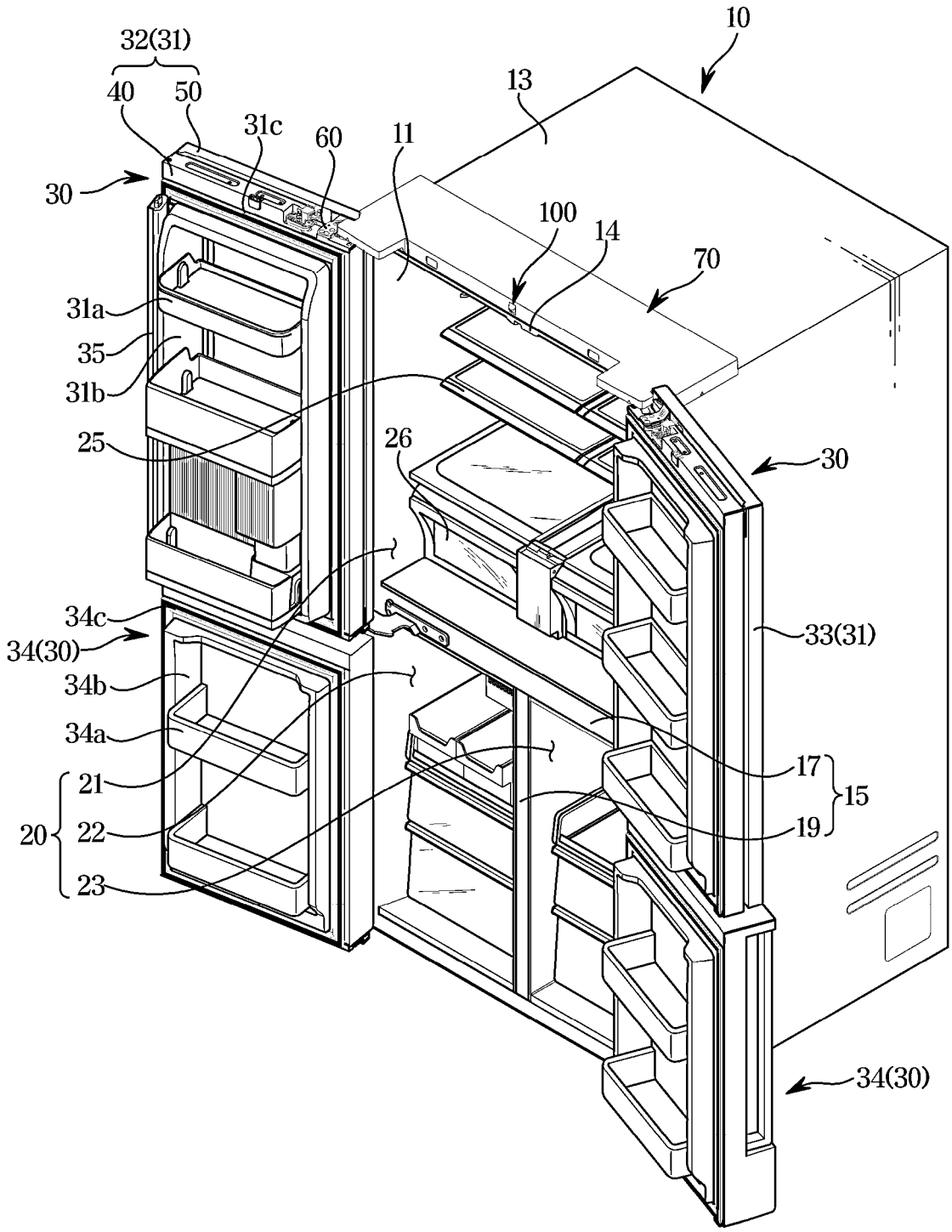
FIG. 2 is a view illustrating the refrigerator with an open door, according to an embodiment.

FIG. 1 is a view illustrating the front of a refrigerator according to an embodiment. FIG. 2 is a view illustrating the refrigerator with an open door, according to an embodiment.

As shown in FIGS. 1 and 2, the refrigerator may include a cabinet 10, a storage compartment 20 formed by dividing the cabinet 10 into upper and lower compartments, a door 30 for opening or closing the storage compartment 20, and a cold air supply device (not shown) for supplying cold air to the storage compartment 20.

The cabinet 10 may include an inner case 11 forming the storage compartment 20, an outer case 13 coupled to an outer side of the inner case 11 to form an exterior thereof, and an insulation (not shown) foamed between the inner case 11 and the outer case 13 to thermally insulate the storage compartment 20.

A machine room (not shown) may be provided at a rear lower side of the cabinet 10, in which a compressor (not shown) for compressing a refrigerant and a condenser (not shown) for condensing the refrigerant compressed by the compressor are installed.

The cold air supply device may include a compressor installed in the machine room to compress the refrigerant, a condenser installed in the machine room to condense the refrigerant, an expansion valve (not shown) to expand the refrigerant condensed by the condenser, an evaporator (not shown) installed at a rear side of the storage compartment 20 to generate cold air, a fan (not shown) to induce cold air generated by the evaporator to be discharged into the storage compartment 20, and a cold air duct (not shown) installed on the rear side of the storage compartment 20 to discharge the cold air induced by the fan into the storage compartment 20. The evaporator, the fan, and the cold air duct disposed at the rear side of the storage compartment 20 may be disposed at the rear side of the refrigerating (or upper) compartment 21 and the freezing (or lower, or first and second) compartments 22 and 23.

The storage compartment 20 may be divided into a plurality of compartments by one or more partitions 15, and the interior of the storage compartments 20 may be provided with a plurality of shelves 25 and storage containers 26 to store food or the like.

The storage compartment 20 may be divided into the plurality of storage compartments 21, 22, and 23 by the partitions 15. The partitions 15 may include a first partition 17 coupled horizontally to the storage compartment 20 to divide the storage compartment 20 into the upper storage compartment 21 and the lower storage compartments 22 and 23, and a second partition 19 coupled vertically to the lower storage compartments 22 and 23 to divide the lower storage compartments 22 and 23 into the first storage compartment 22 and the second storage compartment 23.

The partition 15, which has a T-shape by coupling the first partition 17 and the second partition 19, may divide the storage compartment 20 into three spaces. Of the upper storage compartment 21 and the lower storage compartments 22 and 23 divided by the first partition 17, the upper storage compartment 21 may be used as a refrigerating compartment, and the lower storage compartments 22 and 23 may be used as a freezing compartment.

The lower storage compartments 22 and 23 may be used entirely as a freezing compartments, but the first storage compartment 22 may be used as a freezing compartment and the second storage compartment 23 may be used as a refrigerating compartment, or the first storage compartment 22 may be used as a freezing compartment and the second storage compartment 23 may be used as both a refrigerating compartment and a freezing compartment.

The division of the storage compartment 20 as described above may be by way of example, and each of the storage compartments 21, 22, and 23 may be used differently from the above configuration.

The refrigerating compartment 21 and the freezing compartments 22 and 23 may each be opened and closed by a door 30 rotatably coupled to the cabinet 10.

The door 30 may include a pair of refrigerating compartment doors 31 rotatably coupled to the cabinet 10 to open or close the refrigerating compartment 21. The pair of refrigerating compartment doors 31 may include a first door 32 and a second door 33 rotatably coupled to the left and right sides of the cabinet 10, respectively. The door 30 may include a pair of freezing compartment doors 34 rotatably coupled to the cabinet 10 to open or close the freezing compartments 22 and 23. The doors for opening or closing the freezing compartments 22 and 23 may be sliding doors.

The refrigerating compartment 21 may be opened or closed by the pair of refrigerating compartment doors 31, and at least one of the first door 32 and the second door 33 may be provided with a rotating bar 35 such that when the pair of refrigerating compartment doors 31 are closed, the first door 32 and the second door 33 may be sealed without a gap therebetween. The rotating bar 35 may be rotatably coupled to at least one of the pair of refrigerating compartment doors 31. The rotating bar 35 may be guided to rotate in response to opening or closing of the refrigerating compartment door 31 by a rotation guide 14 formed in the cabinet 10.

Door baskets 31*a* and 34*a* for storing food may be provided on rear surfaces of the pair of refrigerating compartment doors 31 and the pair of freezing compartment doors 34, respectively.

The door baskets 31*a* and 34*a* may include basket supports 31*b* and 34*b* extending vertically from the respective doors 31 and 34 to support the respective door baskets 31*a* and 34*a* on both left and right sides of the respective door baskets 31*a* and 34*a*, respectively. The basket supports 31*b* and 34*b* may be provided to extend from the respective doors 31 and 34. The basket supports 31*b* and 34*b* may be detachably disposed on the respective doors 31 and 34 in a separate configuration.

In addition, gaskets 31*c* and 34*c* may be provided on rear edges of the respective doors 31 and 34 to seal the gap between the door and the cabinet 10 when the respective doors 31 and 34 are closed. The gaskets 31*c* and 34*c* may be installed in a loop shape along the edge of the rear surface of the respective doors 31 and 34, and may include a magnet (not shown) therein.

The pair of refrigerating compartment doors 31 may be provided as a double door, each including an inner door 40 and an outer door 50.

The inner door 40 may be rotatably connected to the cabinet 10 by a first hinge (not shown), and may open or close the refrigerating compartment 21. The door basket 31*a*, the basket support 31*b*, and the gasket 31*c* described above may be arranged on the inner door 40. The first hinge may be prevented from being exposed to the outside by an upper table 70 provided at an upper portion of the cabinet 10. In other words, the upper table 70 provided at a front surface of the upper portion of the cabinet 10 may be provided to cover an upper portion of the first hinge.

The inner door 40 may include an opening (not shown) formed to allow a user to access the door basket 31*a* so as to store or remove food in a state in which the inner door 40 is closed. The opening may be formed through the inner door 40 and may be opened and closed by the outer door 50.

The outer door 50 may be arranged on a front side of the inner door 40 to open or close the opening of the inner door 40, and may be rotatably arranged in the same direction as the inner door 40. Although the outer door 50 is shown as being rotatably supported by a second hinge 60 installed on the inner door 40 and thus rotatable with respect to the inner door 40, the outer door 50 is not limited thereto, and it may also be possible for the second hinge 60 to be installed on the cabinet 10 and to be rotatable with respect to the cabinet 10.

The refrigerator may include a camera device 100 capable of obtaining images of the outside and/or inside of the storage compartment 20. The camera device 100 may be installed in the upper table 70. The camera device 100 may be installed such that a portion thereof protrudes outwardly from a front surface of the upper table 70. The camera device 100 will be described in more detail below.

Figure 3:
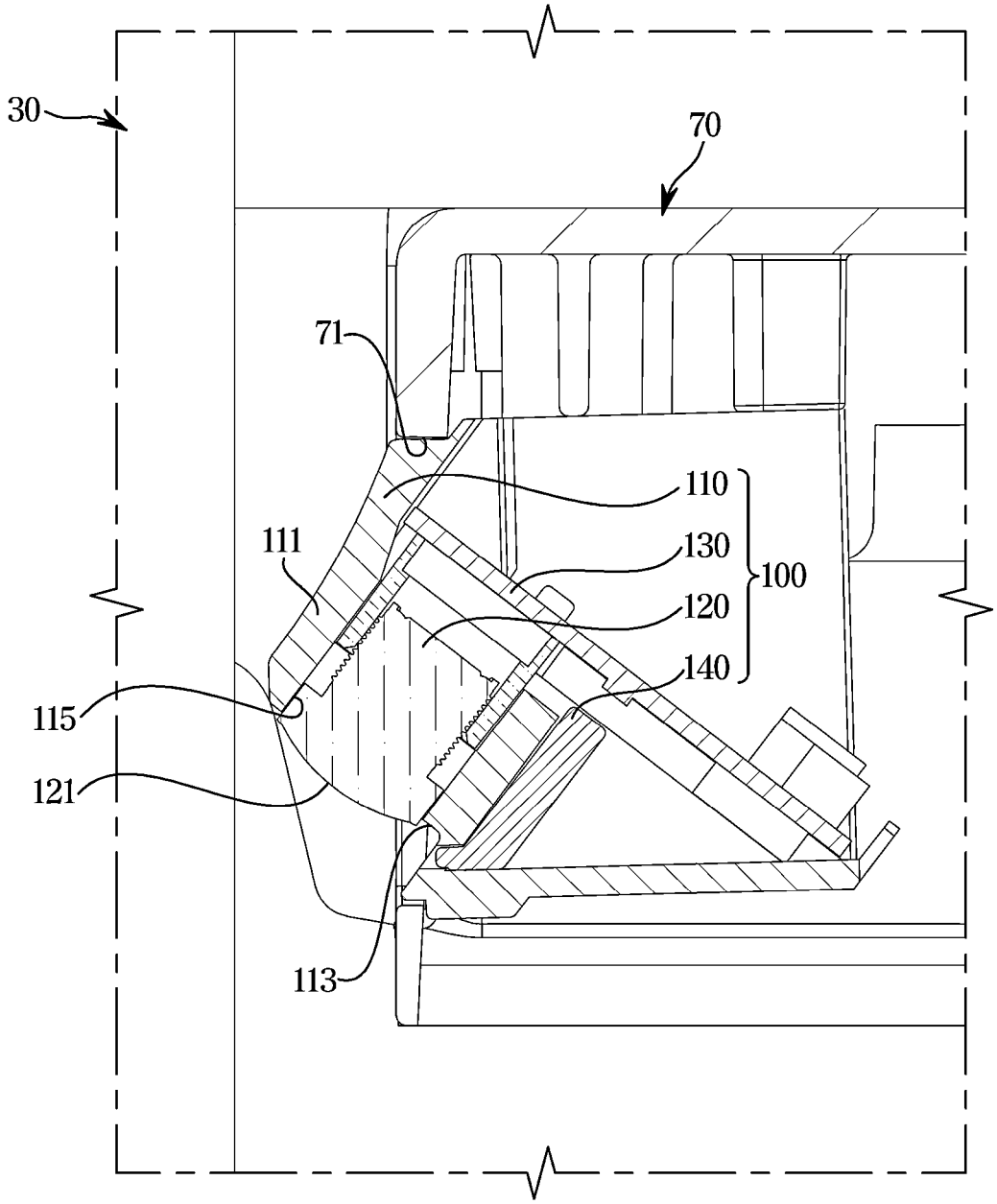
FIG. 3 is a cross-sectional view schematically illustrating a camera device installed in the refrigerator according to an embodiment.
Figure 4:
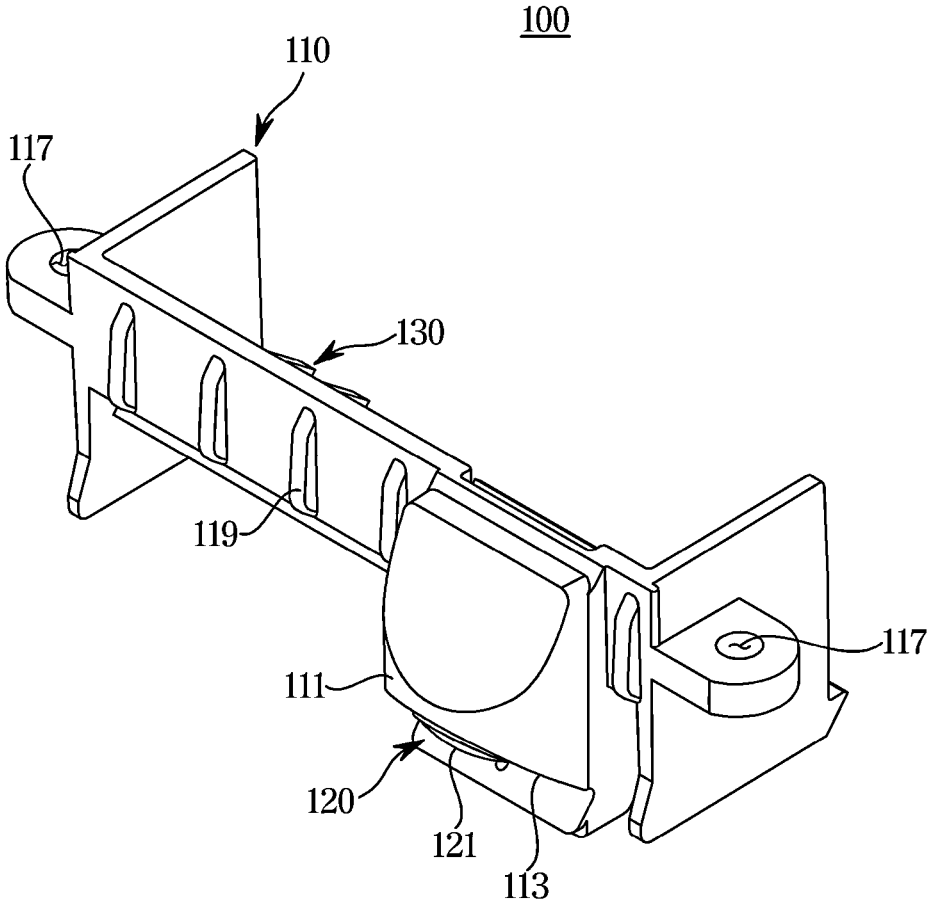
FIG. 4 is a view illustrating the camera device according to an embodiment.
Figure 5:
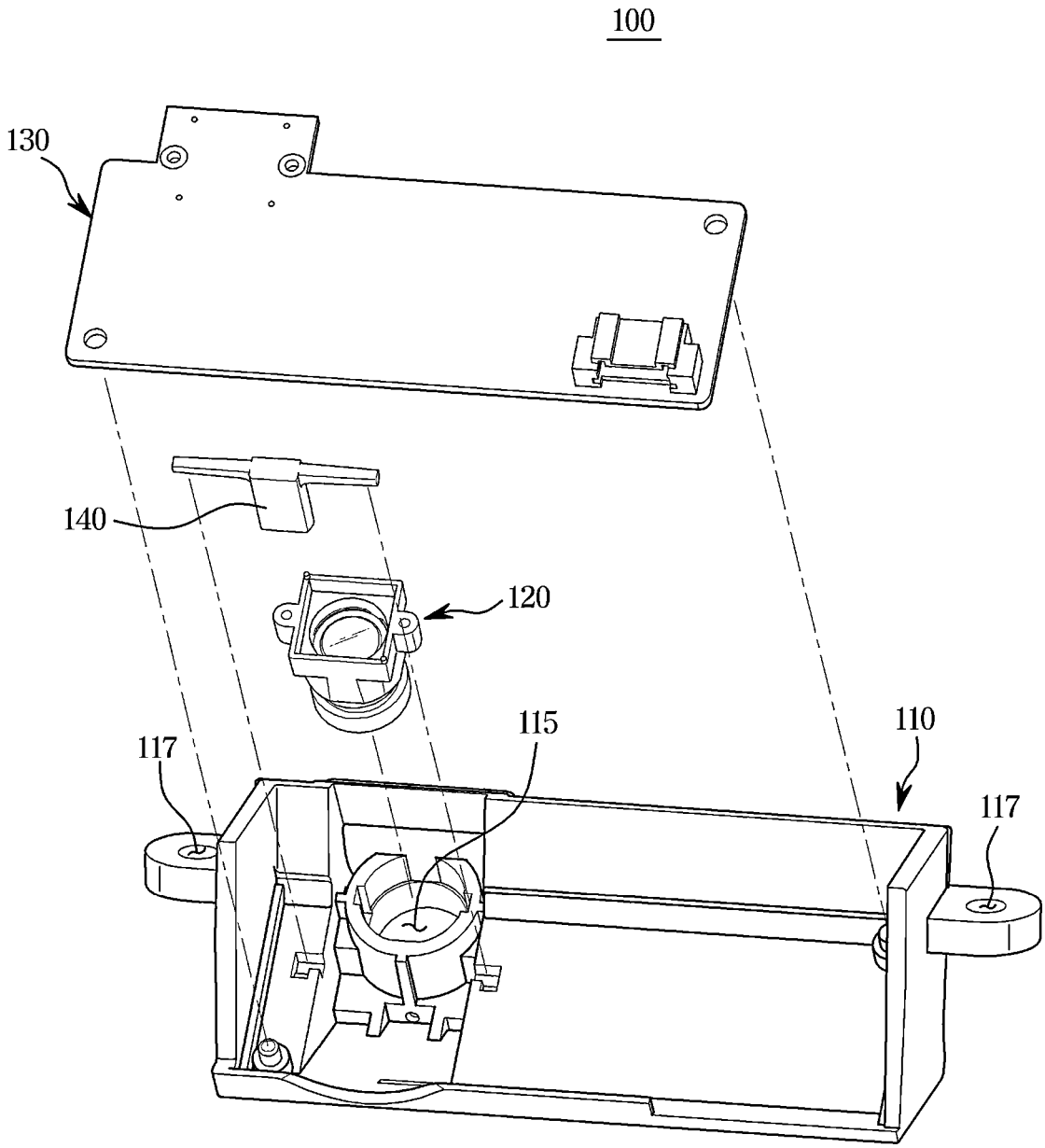
FIG. 5 is a view illustrating a camera, a controller, and an LED indicator separated from a bracket of the camera device according to an embodiment.
Figure 6:
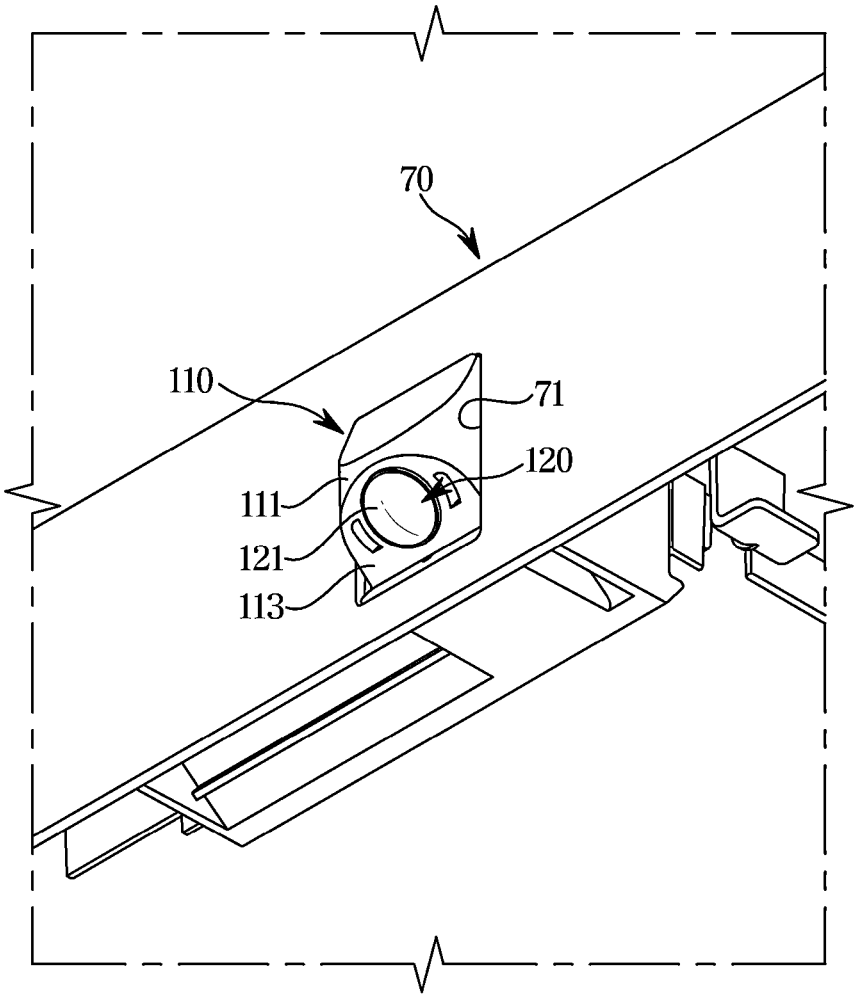
FIG. 6 is a view illustrating an inclined portion of the camera device according to an embodiment.
Figure 7:
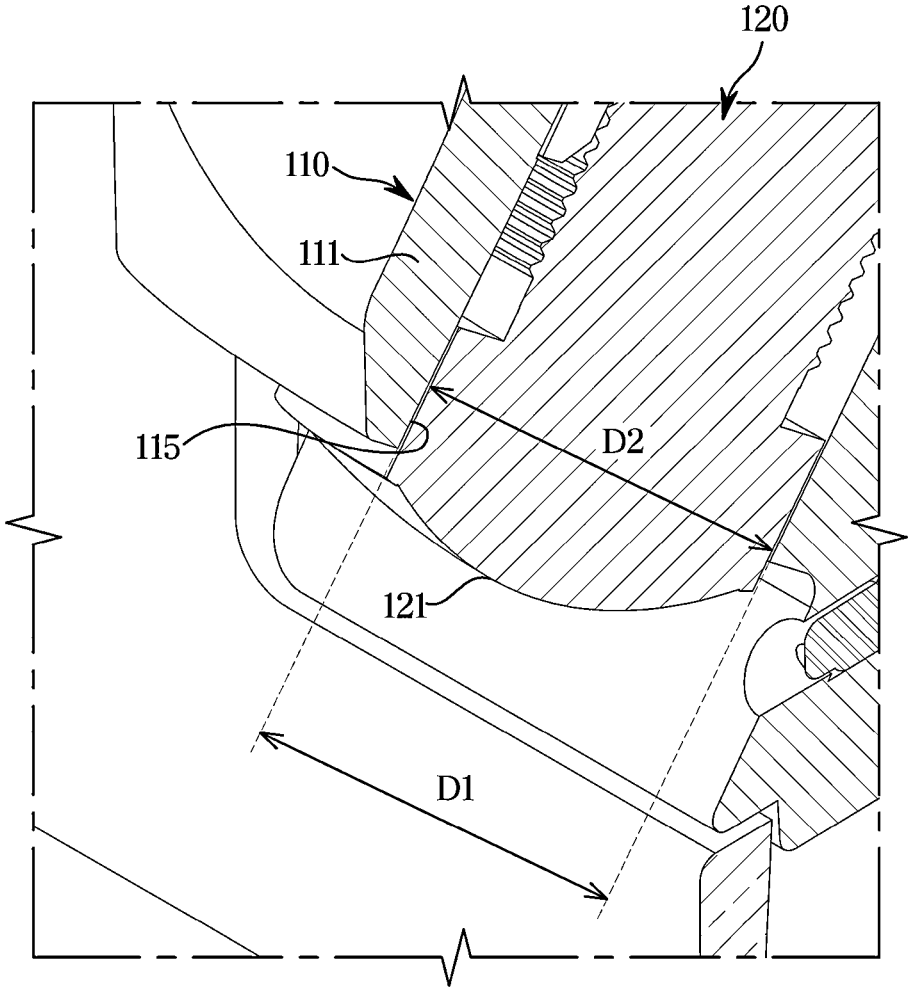
FIG. 7 is a cross-sectional view schematically illustrating a lens of the camera exposed to the outside through an opening in the bracket, according to an embodiment.
Figure 8:
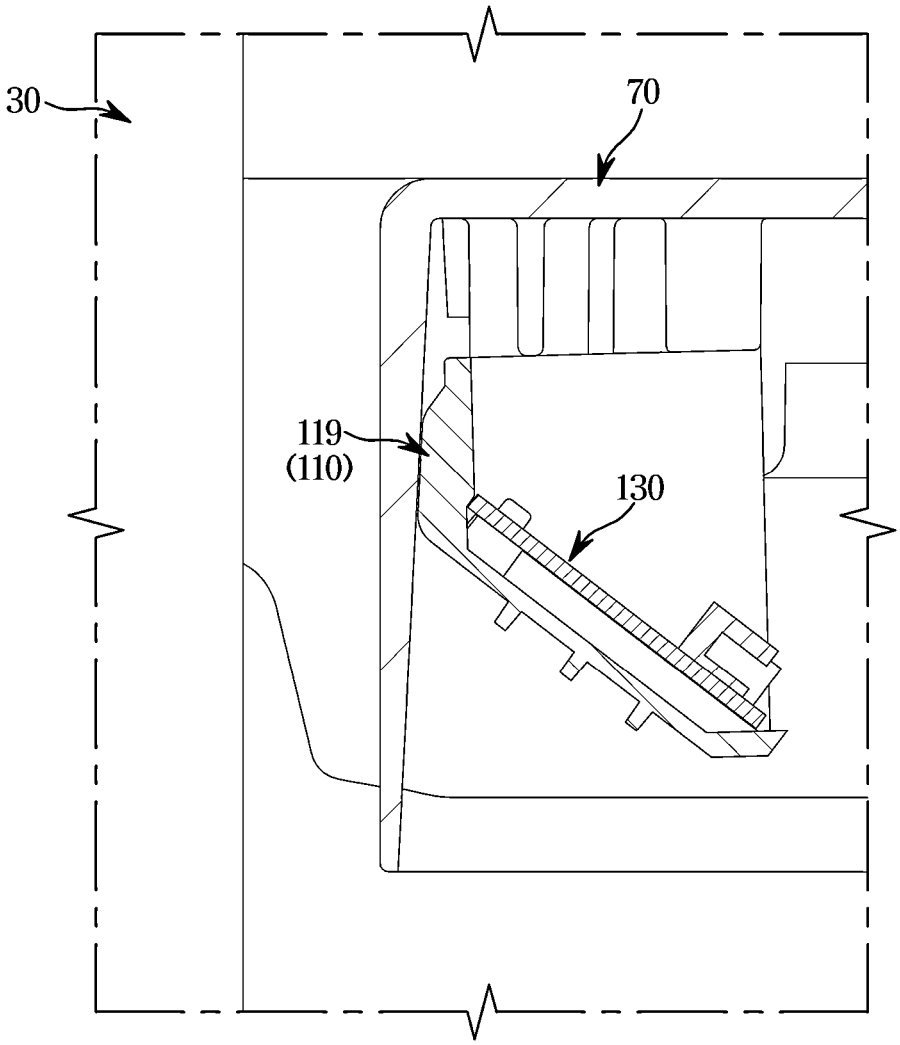
FIG. 8 is a cross-sectional view schematically illustrating anti-movement ribs of the bracket in contact with an upper table, according to an embodiment.

FIG. 3 is a cross-sectional view schematically illustrating the camera device installed in the refrigerator according to an embodiment. FIG. 4 is a view illustrating the camera device according to an embodiment. FIG. 5 is a view illustrating a camera, a controller, and a light emitting diode (LED) indicator detached from a bracket of the camera device according to an embodiment. FIG. 6 is a view illustrating an inclined portion of the camera device according to an embodiment. FIG. 7 is a cross-sectional view schematically illustrating a lens of the camera exposed to the outside through an opening in the bracket, according to an embodiment. FIG. 8 is a cross-sectional view schematically illustrating anti-movement ribs of the bracket in contact with the upper table according to an embodiment.

As shown in FIGS. 3 to 8, the camera device 100 may be installed on the inside of the upper table 70. The camera device 100 may be installed such that a portion thereof protrudes outwardly from the front surface of the upper table 70. A mounting hole 71 may be formed on the front surface of the upper table 70 to allow a portion of the camera device 100 to be installed by protruding outside the front surface of the upper table 70. A portion of the camera device 100 may protrude outside the upper table 70 through the mounting hole 71 formed on the front surface of the upper table 70 (see FIG. 2)

The camera device 100 may include a bracket 110 installed on the upper table 70. The camera device 100 may include a camera 120 installed on the bracket 110 to capture the outside and/or inside of the storage compartment 20. The camera device 100 may include a controller 130 installed on the bracket 110 to control the operation of the camera 120. The camera device 100 may include an LED indicator 140 installed on the bracket 110 to provide an external indication that the camera 120 is operational when the camera 120 is activated by the controller 130.

The bracket 110 may be installed on the upper table 70. The bracket 110 may be installed within the upper table 70. The bracket 110 may be installed on the upper table 70 to be exposed to the outside through the mounting hole 71. The bracket 110 may partially protrude outside of the upper table 70 through the mounting hole 71.

The bracket 110 may include a protruding portion 111 that protrudes outside of the upper table 70 through the mounting hole 71. The camera 120 may be accommodated in the protruding portion 111. The camera 120 may be accommodated in the protruding portion 111. The camera 120 accommodated in the protruding portion 111 may protrude outside of the upper table 70 and capture the outside of the storage compartment 20. The protruding portion 111 may protrude outside of the upper table 70 by a length less than a gap L1 between the front surface of the upper table 70 and the door 30. The protruding portion 111 may protrude outside of the upper table 70 by a length less than the gap L1 between the front surface of the upper table 70 and the door 30 to prevent collision with the door 30 when the door 30 is closed. In other words, a protruding length L2 of the protruding portion 111 may be smaller than the gap L1 between the front surface of the upper table 70 and the door 30. The gap L1 between the front surface of the upper table 70 and the door 30 may be 10 mm. The protruding length L2 of the protruding portion 111 may be less than 10 mm. The protruding length L2 of the protruding portion 111 may be about 6.24 mm from the front surface of the upper table 70 (see FIG. 15).

The gasket 31*c* may be arranged on the rear surface of the door 30 to prevent cold air in the storage compartment 20 from leaking out by contacting the cabinet 10 when the door 30 is closed. The gap L1 between the front surface of the upper table 70 and the door 30 may be the same as the thickness of the gasket 31*c*. That is, the protruding portion 111 may protrude outside of the upper table 70 by a length less than the thickness of the gasket 31*c* (see FIG. 15).

The bracket 110 may include an inclined portion 113 formed to be inclined at a lower portion of the protruding portion 111. The inclined portion 113 may be formed to be inclined at the lower portion of the protruding portion 111 toward a front side of the refrigerator. The camera 120 may capture a portion of the interior of the storage compartment 20 through the inclined portion 113. The inclined portion 113 may be formed to be inclined at approximately 36.2 degrees from the front surface of the upper table 70. The angle of inclination of the inclined portion 113 may determine a capture area to be captured by the camera 120. When the inclined portion 113 is formed to be inclined by approximately 36.2 degrees from the front surface of the upper table 70, the camera 120 may capture a portion of the inside of the storage compartment 20 together with the outside of the storage compartment 20.

The inclined portion 113 may include an opening 115 through which a lens 121 of the camera 120 is exposed to the outside. The lens 121 of the camera 120 may be exposed to the outside through the opening 115, so that the camera 120 may capture the outside and/or inside of the storage compartment 20. To prevent water and/or dust from entering a gap between the lens 121 and the opening 115 of the camera 120, a diameter D1 of the opening 115 may be set to have a minimum length through which the lens 121 may be assembled. The diameter D1 of the opening 115 may be 0.1 mm larger than a diameter D2 of the lens 121. In other words, the diameter D1 of the opening 115 may be formed to be 0.1 mm larger than the diameter D2 of the lens 121 so that the lens 121 of the camera 120 is waterproof and/or dustproof. The diameter D1 of the opening 115 may be approximately 9.1 mm. The diameter D2 of the lens 121 may be approximately 9.0 mm.

The bracket 110 may include a pair of first coupling holes 117 for coupling the bracket 110 to the upper table 70. The bracket 110 may be coupled to the upper table 70 by a screw S coupled to the first coupling holes 117. This will be described in more detail below.

The bracket 110 may include anti-movement ribs 119 that prevents the bracket 110 from being moved by impacts generated during the opening and closing of the door 30. The anti-movement ribs 119 may be provided in a plurality. The anti-movement ribs 119 may be provided on one surface that is in contact with the upper table 70 when the bracket 110 is coupled to the upper table 70.

The camera 120 may be mounted on the bracket 110. The camera 120 may be accommodated in the protruding portion 111 of the bracket 110. The camera 120 accommodated in the protruding portion 111 of the bracket 110 may capture the outside and/or inside of the storage compartment 20 through the opening 115 of the inclined portion 113. The camera 120 may include the lens 121 exposed through the opening 115 so as to capture the outside and/or inside of the storage compartment 20 through the opening 115 of the inclined portion 113.

The controller 130 may be mounted on the bracket 110. The controller 130 may control the operation of the camera 120. The controller 130 may be connected to a door opening/closing device (not shown) that detects the opening and closing of the door 30. The controller 130 may cause the camera 120 to start image capturing when the door opening/closing device detects the opening of the door 30. In other words, the controller 130 may activate the camera 120 in response to the opening of the door 30. The controller 130 may operate the camera 120 to enable the camera 120 to start image capturing when only one of the first door 32 and the second door 33 is opened (see FIG. 2).

The LED indicator 140 may be mounted on the bracket 110. The LED indicator 140 may provide an external confirmation that the camera 120 is operational when the camera 120 is activated by the controller 130.

Figure 9:
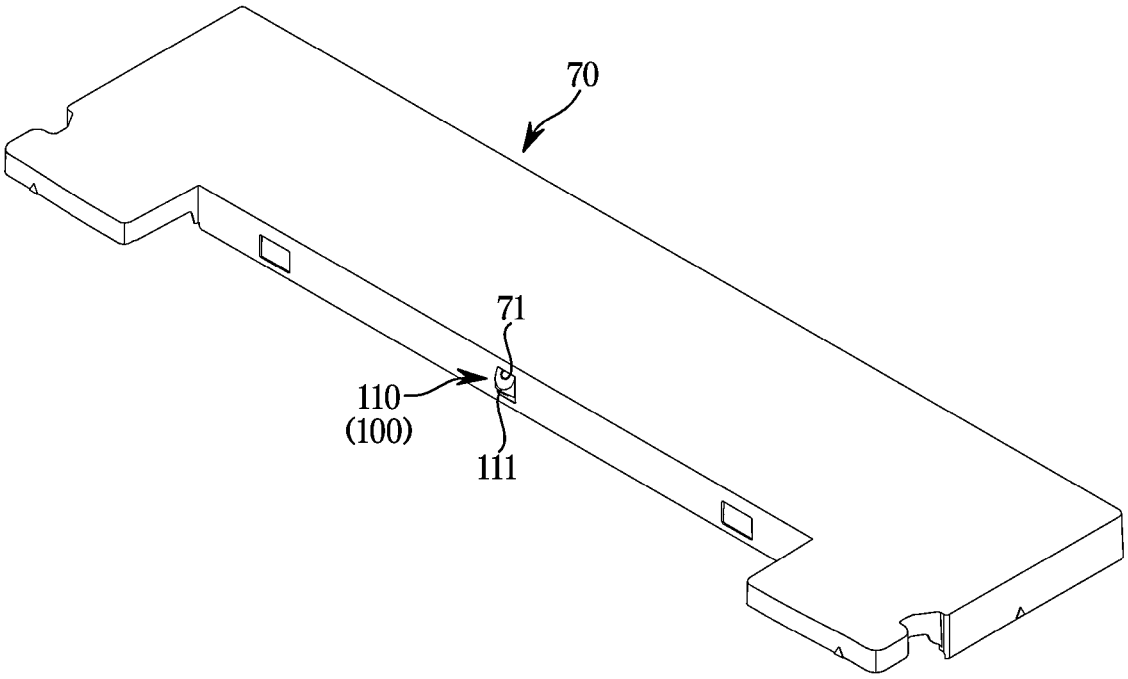
FIG. 9 is a view illustrating the camera device coupled to the upper table, according to an embodiment.
Figure 10:
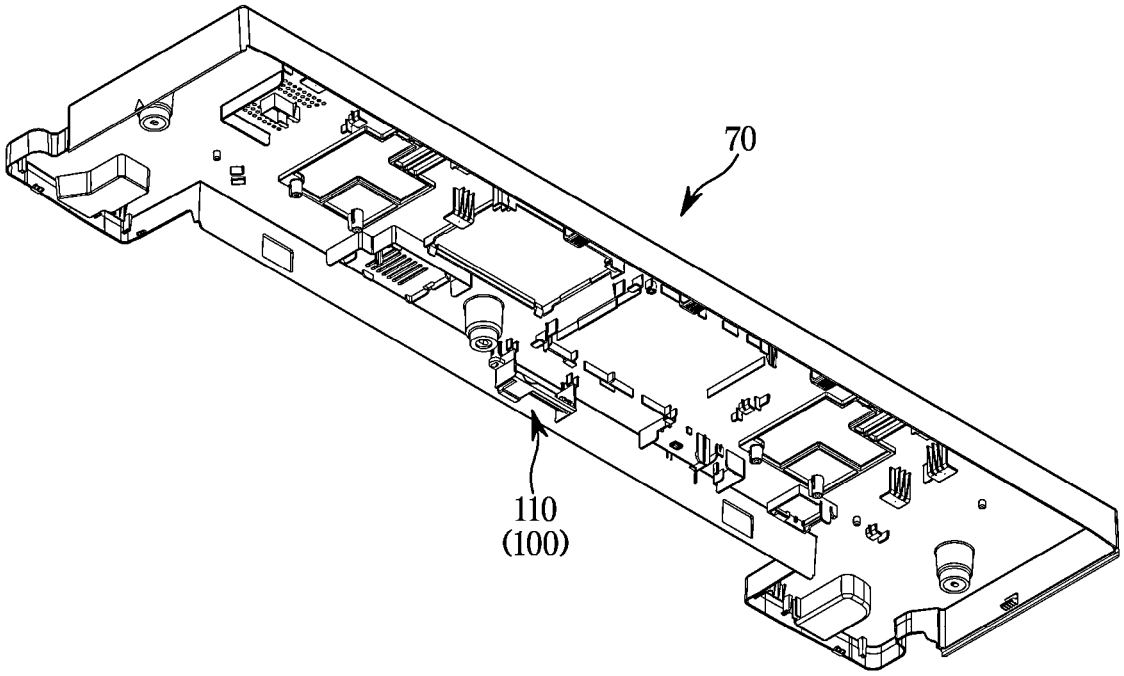
FIG. 10 is a view illustrating the camera device coupled to the interior of the upper table, according to an embodiment.
Figure 11:
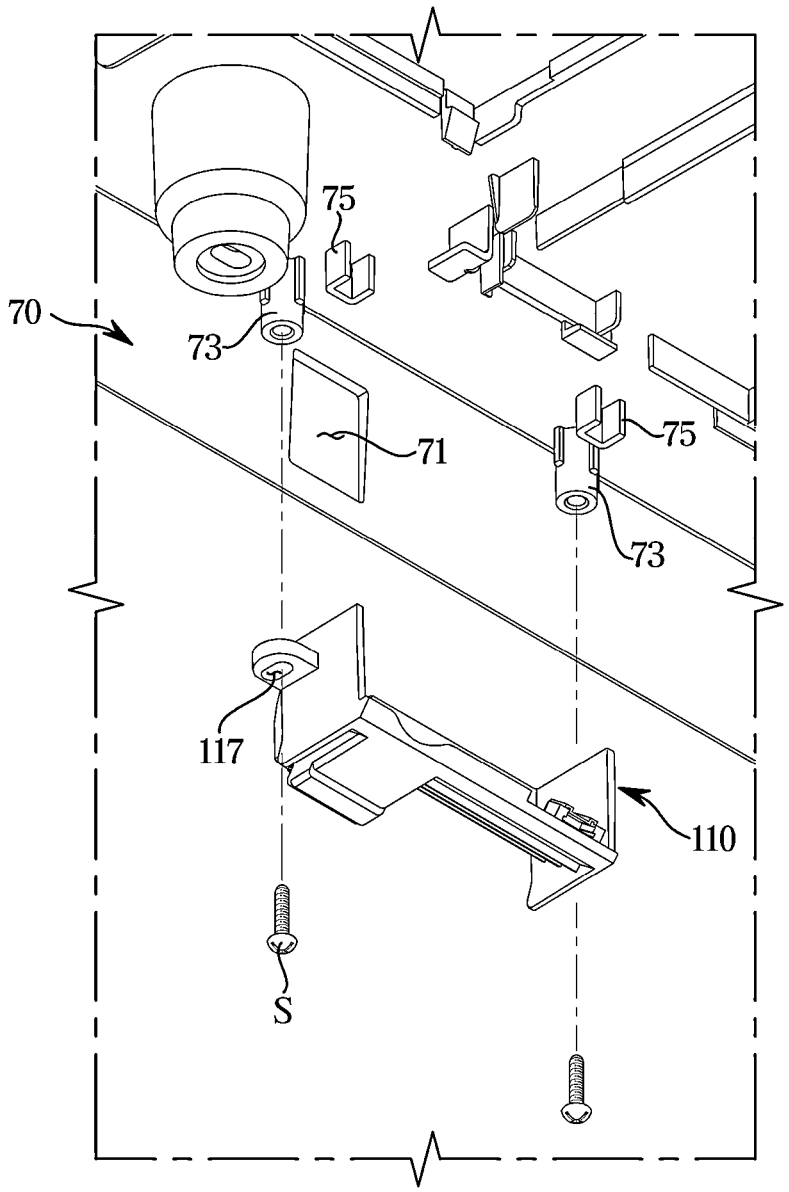
FIG. 11 is a view illustrating the camera device coupled to the upper table, according to an embodiment.
Figure 12:
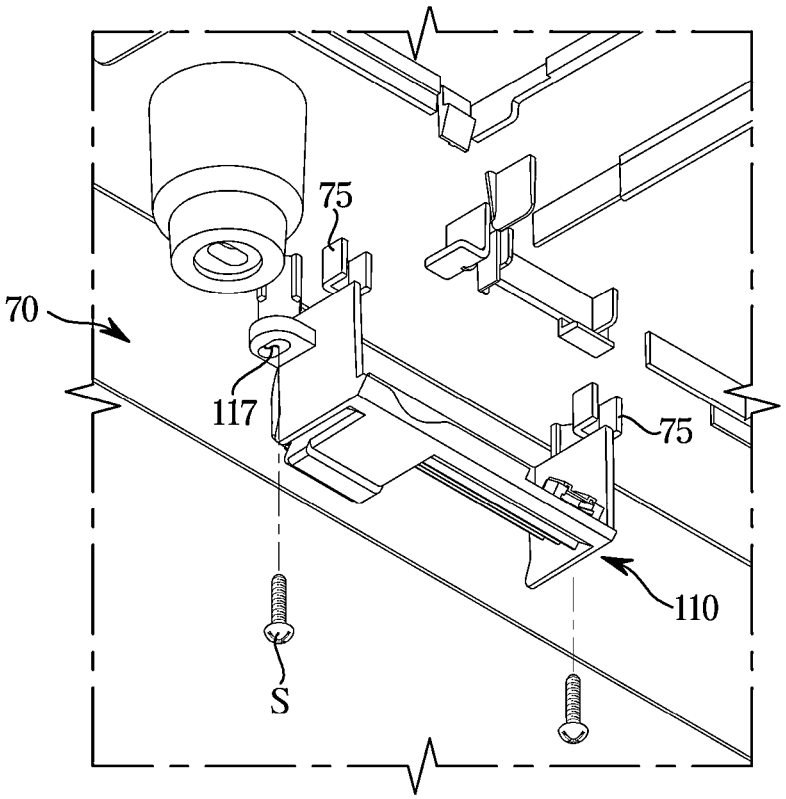
FIG. 12 is a view illustrating the camera device according to an embodiment being supported on a pair of support ribs of the upper table for coupling to the upper table.
Figure 13:
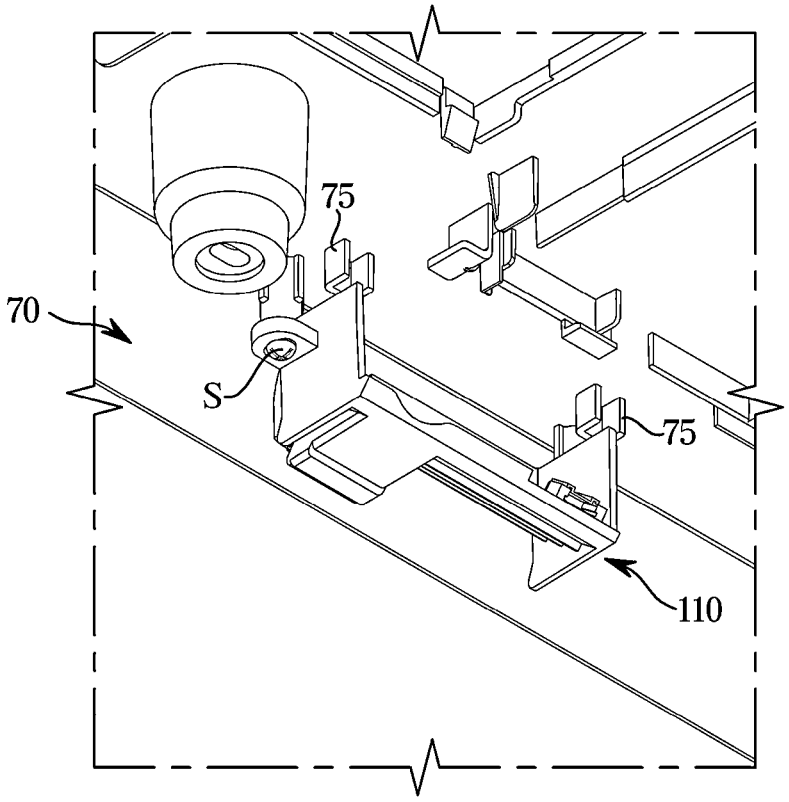
FIG. 13 is a view of the camera device coupled to the upper table, according to an embodiment.

FIG. 9 is a view illustrating the camera device coupled to the upper table, according to an embodiment. FIG. 10 is a view illustrating the camera device coupled to the interior of the upper table, according to an embodiment. FIG. 11 is view illustrating the camera device coupled to the upper table, according to an embodiment. FIG. 12 is a view illustrating the camera device according to an embodiment supported on a pair of support ribs of the upper table in order to be coupled to the upper table. FIG. 13 is a view illustrating the camera device coupled to the upper table, according to an embodiment.

As shown in FIGS. 9 and 10, the bracket 110 of the camera device 100 may be coupled to the inside of the upper table 70. As viewed from the outside of the upper table 70, a portion of the bracket 110 may protrude outside through the mounting hole 71 of the upper table 70. The protruding portion 111 of the bracket 110 may protrude outside through the mounting hole 71 of the upper table 70.

As shown in FIG. 11, the bracket 110 of the camera device 100 may be coupled to the upper table 70 with the camera 120, the controller 130, and the LED indicator 140 installed on the bracket 110. The bracket 110 may include the pair of first coupling holes 117 coupled to the upper table 70. The upper table 70 may include a pair of second coupling holes 73 to which the bracket 110 is coupled. The pair of first coupling holes 117 of the bracket 110 and the pair of second coupling holes 73 of the upper table 70 may be coupled by the screws S.

As shown in FIGS. 12 and 13, the upper table 70 may include a pair of support ribs 75. The pair of support ribs 75 may be formed around the pair of second coupling holes 73. Before the bracket 110 is coupled to the upper table 70 by the screw S, the bracket 110 may be supported on the pair of support ribs 75 of the upper table 70. When the bracket 110 is supported on the pair of support ribs 75, the pair of first coupling holes 117 of the bracket 110 and the pair of second coupling holes 73 of the upper table 70 may be aligned to be coupled by the screws S. In other words, when the bracket 110 is coupled to the upper table 70, the bracket 110 may be coupled to the upper table 70 by the screw S while being supported on the pair of support ribs 75.

Figure 14:
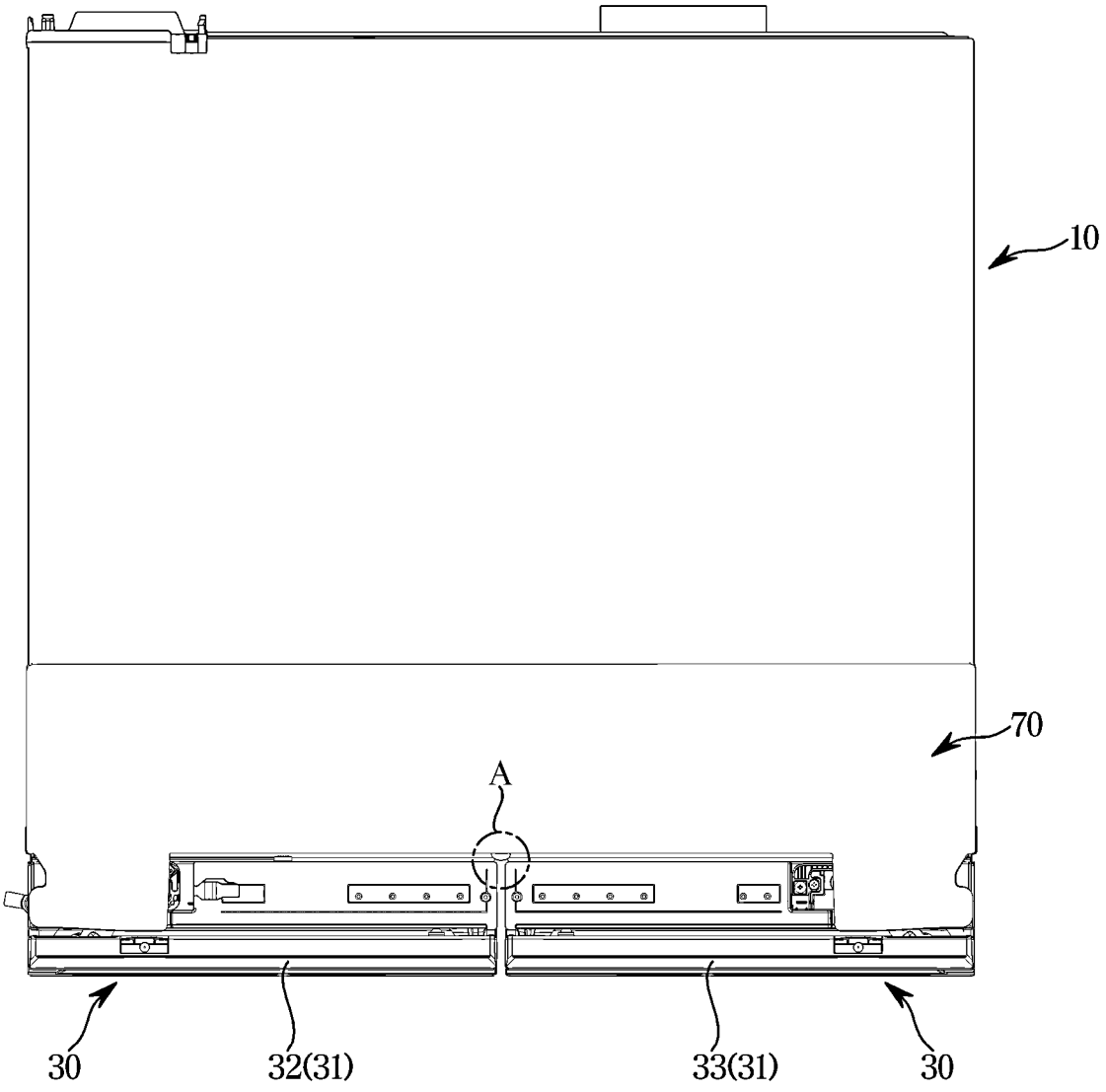
FIG. 14 is a top view of the refrigerator with the door closed, according to an embodiment.
Figure 15:
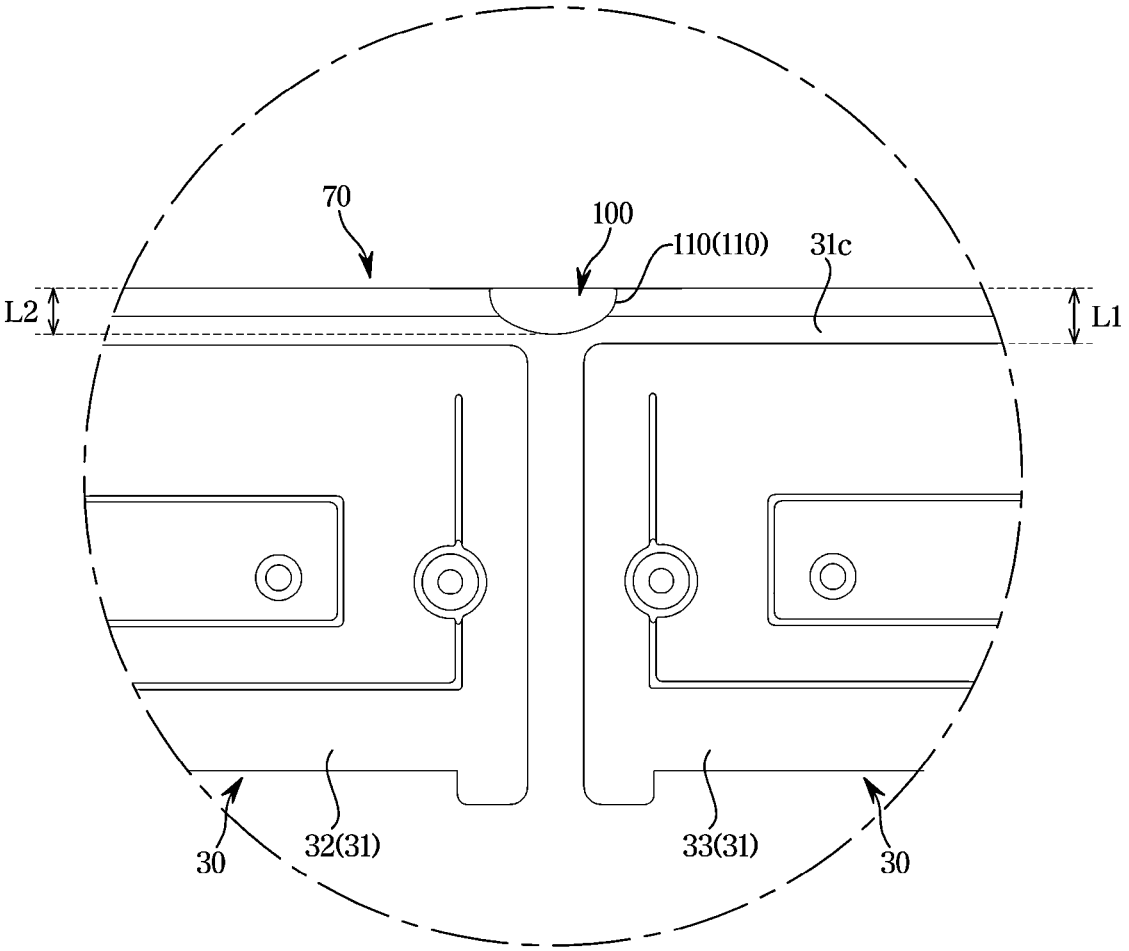
FIG. 15 is an enlarged view of portion A of FIG. 14.
Figure 16:
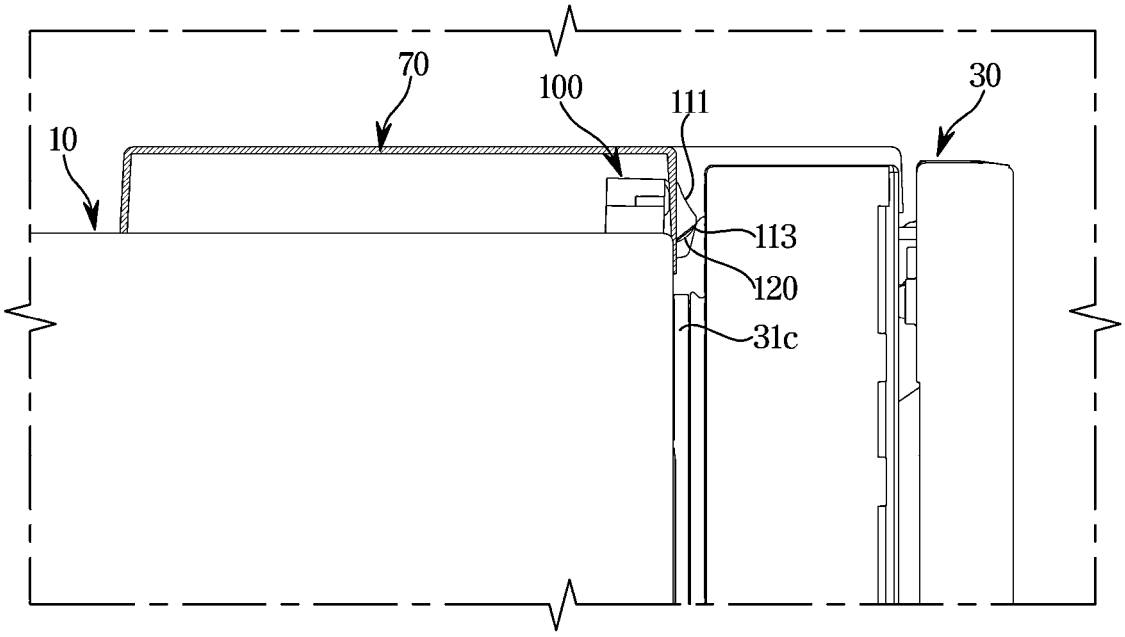
FIG. 16 is a side cross-sectional view schematically illustrating a portion of the camera device protruding outside of the upper table, according to an embodiment.
Figure 17:
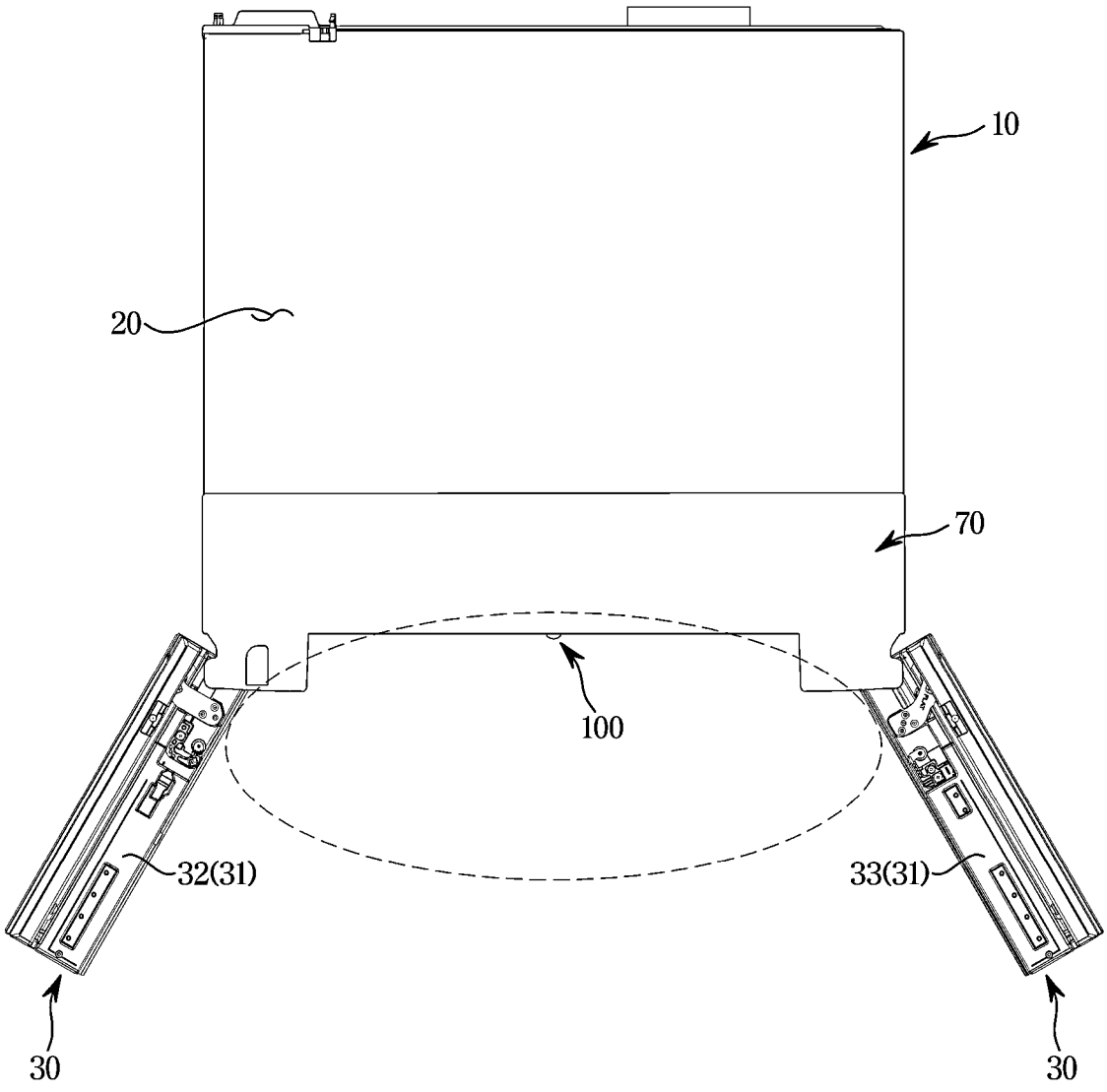
FIG. 17 is a view illustrating a capture area of the camera when the door is open, according to an embodiment.

FIG. 14 is a view illustrating the refrigerator with the closed door viewed from above, according to an embodiment. FIG. 15 is an enlarged view of portion A of FIG. 14. FIG. 16 is a side cross-sectional view schematically illustrating a portion of the camera device protruding outside of the upper table, according to an embodiment. FIG. 17 is a view illustrating the capture area of the camera when the door is open, according to an embodiment.

As shown in FIGS. 14 to 16, the camera device 100 mounted on the upper table 70 may have the protruding portion 111 of the bracket 110 protruding outside the upper table 70. The protruding length L2 of the protruding portion 111 may be smaller than the gap L1 between the front surface of the upper table 70 and the door 30. In other words, the protruding length L2 of the protruding portion 111 may be smaller than the thickness of the gasket 31*c*. As a result, the protruding portion 111 may be prevented from colliding with the door 30 when the door 30 is closed.

As shown in FIG. 17, when the door 30 is opened, the camera 120 may start to capture images under control by the controller 130. In response to the opening of the door 30, the camera 120 may capture an image of the outside of the storage compartment 20. The camera 120 may shoot the outside of the storage compartment 20 to capture an image or images of food being placed into the storage compartment 20 for storage, or food being taken out of the storage compartment 20 to use the food stored in the storage compartment 20. In addition, the camera 120 may capture an image or images of a portion of the inside of the storage compartment 20. In other words, the camera 120 may capture an image of a portion of the outside and/or inside of the storage compartment 20.

Figure 18:
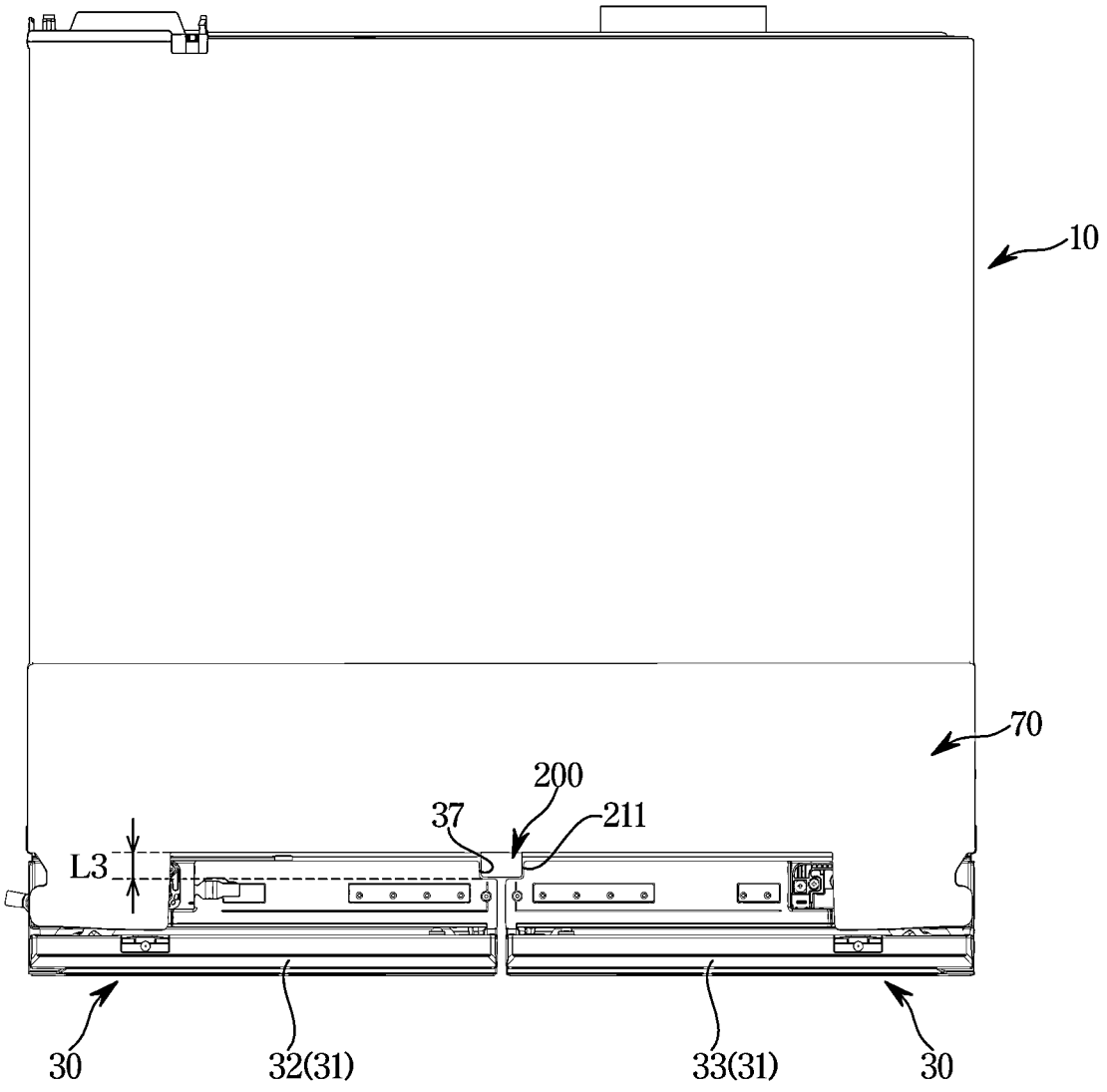
FIG. 18 is a top view illustrating the refrigerator with the door closed, when a length of the camera device protruding outside of the upper table is longer than a gap between a front surface of the upper table and the door, according to an embodiment.
Figure 19:
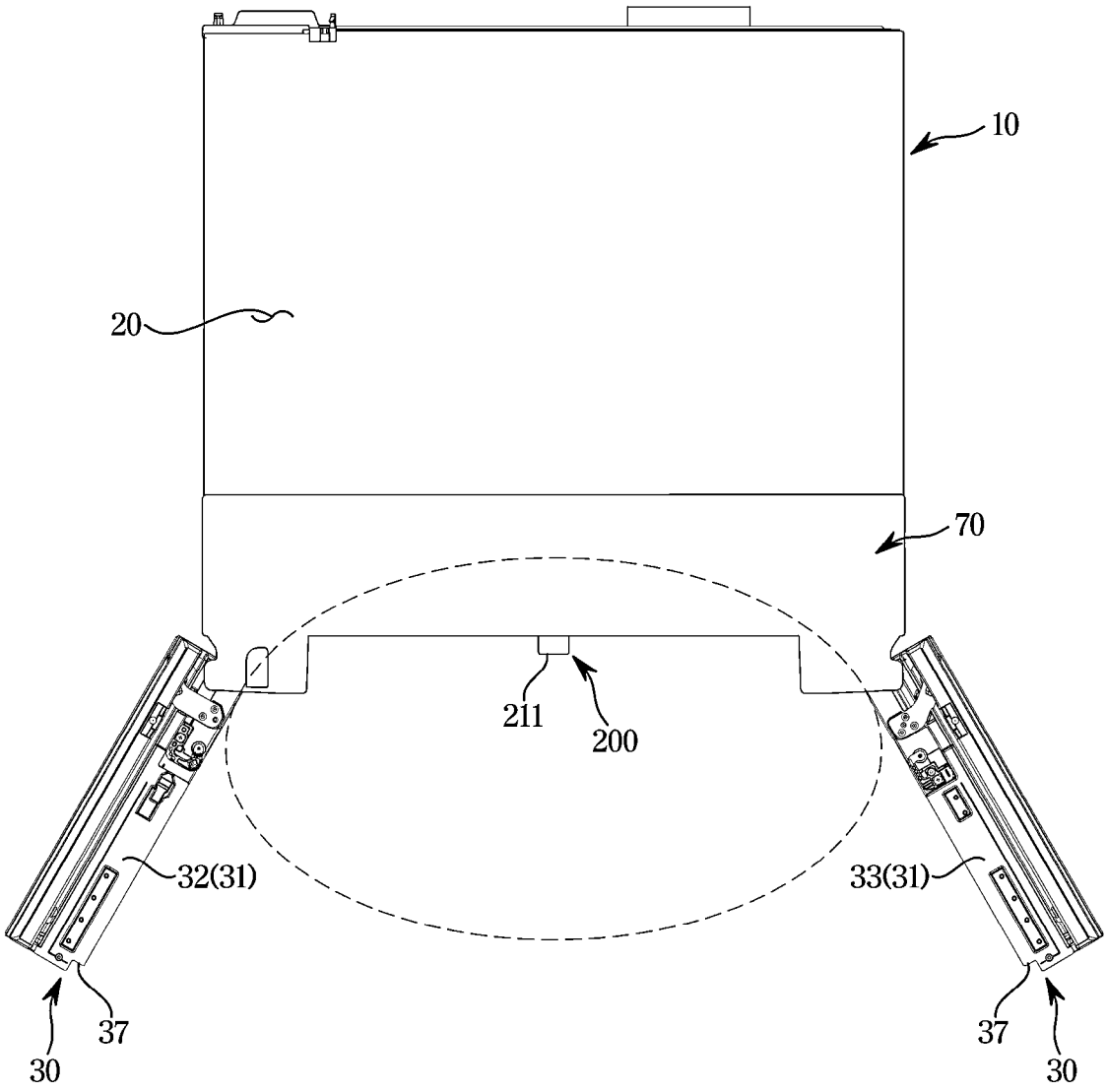
FIG. 19 is a view illustrating the refrigerator shown in FIG. 18 with the door open.

FIG. 18 is a top view illustrating the refrigerator with the door closed when the length of the camera device protruding outside the upper table is longer than the gap between the front surface of the upper table and the door, according to an embodiment. FIG. 19 is a view illustrating the refrigerator shown in FIG. 18 with the door open.

As shown in FIG. 18, a portion of a camera device 200 mounted on the upper table 70 may protrude outside of the upper table 70. The portion of the camera device 200 protruding outwardly from the upper table 70 may be a protruding portion 211. A protruding length L3 of the protruding portion 211 may be larger than the gap L1 between the front surface of the upper table 70 and the door 30. In other words, the protruding length L3 of the protruding portion 111 may be greater than the thickness of the gasket 31*c*. Since the protruding length L3 of the protrusion 211 is greater than the gap L1 between the front surface of the upper table 70 and the door 30, the door 30 may include a recessed portion 37 formed by recessing a portion of the rear surface of the door in order to prevent the protruding portion 211 from colliding with the door when the door 30 is closed. When the door 30 is closed, the protruding portion 211 of the camera device 200 may be accommodated in the recessed portion 37 of the door 30. The camera device 200 may have the same configuration except that the protruding length L3 and the width of the protruding portion 211 may be greater than the protruding length L2 and the width of the protruding portion 111 of the camera device 100 shown in FIGS. 1 to 17.

As shown in FIG. 19, when the protruding length L3 of the protrusion 211 is greater than the gap L1 between the front surface of the upper table 70 and the door 30, the camera device 200 may capture an image of a wider area. In other words, the camera device 200 may capture an image of a wider area outside the storage compartment 20. In addition, the camera device 200 may also capture an image of a wider area inside the storage compartment 20.

A refrigerator according to an embodiment of the present disclosure may include the cabinet 10, the storage compartment 20 in the cabinet, the door 30 rotatably coupled to the cabinet to open or close the storage compartment, the upper table 70 on an upper surface of the cabinet and having the mounting hole 71 formed on a front surface, the bracket 110 mountable on the upper table to allow a portion thereof to protrude outside the upper table through the mounting hole, and the camera 120 mountable on the bracket to capture the outside and inside of the storage compartment. The bracket may include the protruding portion 111 accommodating the camera and protruding outside the upper table by a length less than the gap L1 between the front surface of the upper table and the door through the mounting hole so as to capture the outside of the storage compartment, and the inclined portion 113 including an opening 115 through which a lens of the camera is exposed to the outside, and formed to be inclined at a lower portion of the protruding portion such that the camera captures the inside of the storage compartment.

The door may include the gasket 31*c* on a rear surface of the door and in contact with the cabinet when the door is closed, and the gap between the front surface of the upper table and the door may be the thickness of the gasket.

The door may include the first door 32 and the second door 33 rotatably coupled to the left and right sides of the cabinet, respectively, and the camera maybe positioned between the first door and the second door.

The refrigerator may further include the controller 130 installed on the bracket to control an operation of the camera.

The refrigerator may further include the LED indicator 140 mountable on the bracket to provide an external confirmation that the camera is operational when the camera is activated by the controller.

The gap L1 between the front surface of the upper table and the door may be 10 mm, and the protruding portion may protrude less than 10 mm from the front surface of the upper table to prevent collision with the door.

The bracket may further include the pair of first coupling holes 117 coupled to the upper table by the screw S.

The upper table may include the pair of second coupling holes 73 coupled to the pair of first coupling holes by the screw.

The upper table may further include the pair of support ribs 75 formed around the pair of second coupling holes and configured to support the bracket when the bracket is coupled to the upper table.

The bracket may further include the plurality of anti-movement ribs 119 in contact with the upper table, the plurality of anti-movement ribs preventing the bracket from being moved during opening and closing of the door.

The diameter of the opening may be 0.1 mm larger than the diameter of the lens so that the lens is waterproof and dustproof.

A refrigerator according to an embodiment of the present disclosure may include the cabinet, the storage compartment 20 within the cabinet, the door 30 rotatably coupled to the cabinet to open or close the storage compartment, the upper table 70 on an upper surface of the cabinet and having the mounting hole 71 formed on a front surface thereof, and the camera device 100 mountable on the upper table to capture the outside and inside of the storage compartment. The camera device includes the camera to capture the outside and inside of the storage compartment, the bracket 110 mountable on the upper table and including the protruding portion 111 protruding outwardly from the upper table through the mounting hole so that the camera captures the outside of the storage compartment and the camera and the inclined portion 113 formed to be inclined at a lower portion of the protruding portion to capture the inside of the storage compartment, and the controller 130 mountable on the bracket to control an operation of the camera.

The protruding portion may protrude outwardly from the upper table by a length smaller than the gap L1 between the front surface of the upper table and the door.

The controller may operate the camera so that the camera starts capturing when the door is opened.

The door may include the first door 32 and the second door 33 rotatably coupled to the left and right sides of the cabinet, respectively, and the camera maybe positioned between the first door and the second door.

The controller may operate the camera so that the camera starts capturing when at least one of the first door and the second door is opened.

The inclined portion may include the opening 115 through which the lens 121 of the camera is exposed to the outside, and the diameter of the opening may be 0.1 mm larger than the diameter of the lens so that the lens is waterproof and dustproof.

According to an embodiment of the present disclosure, the refrigerator may install the camera to capture the insertion and removal of food without deforming the door.

Further, according to an embodiment of the present disclosure, the refrigerator may capture the outside and inside of the storage compartment.

Further, according to an embodiment of the present disclosure, the refrigerator may prevent water and/or dust from entering the lens of the camera that captures the outside and inside of the storage compartment.

Further, according to an embodiment of the present disclosure, the refrigerator may prevent movement of the camera device.

The effects to be obtained from the present disclosure are not limited to those mentioned above, and other effects not mentioned will be apparent to those of skilled in the art to which the present disclosure belongs from the following description.

While the present disclosure has been particularly described with reference to exemplary embodiments, it should be understood by those of skilled in the art that various changes in form and details may be made without departing from the spirit and scope of the present disclosure.

The invention claimed is:

1. A refrigerator comprising:

a cabinet;

a storage compartment in the cabinet;

a door coupled to the cabinet so as to be rotatable to open and close the storage compartment;

an upper table on an upper surface of the cabinet and having a mounting hole formed on a front surface of the upper table;

a bracket mounted on the upper table and including:

a protruding portion, and an inclined portion at a lower portion of the protruding portion and including an opening; and a camera mounted on the bracket and including a lens;

wherein the bracket and the camera are configured so that:

the protruding portion accommodates the camera and protrudes through the mounting hole and outside the upper table by a length less than a gap between the front surface of the upper table and the door to prevent collision with the door when the door is closed, the lens of the camera is exposed through the opening of the inclined portion, and the inclined portion is inclined so that an image captured by the camera includes an area outside the storage compartment and an area inside the storage compartment.

2. The refrigerator of claim 1, wherein the door includes a gasket on a rear surface of the door to be in contact with the cabinet while the door is closed, and the gap between the front surface of the upper table and the door is equal to a thickness of the gasket.

3. The refrigerator of claim 1, wherein the door includes:

a first door coupled to a left side of the cabinet so as to be rotatable to open and close the storage compartment, and a second door coupled to a right side of the cabinet so as to be rotatable to open and close the storage compartment, and while the first door and the second door are rotated so that the storage compartment is closed, the camera is accommodated in the bracket at a position between the first door and the second door.

4. The refrigerator of claim 1, further comprising:

a controller mounted on the bracket to control an operation of the camera.

5. The refrigerator of claim 4, further comprising:

a light emitting diode (LED) indicator mounted on the bracket to provide an external confirmation that the camera is operational while the camera is activated by the controller.

6. The refrigerator of claim 1, wherein the gap between the front surface of the upper table and the door is 10 mm, and the protruding portion protrudes less than 10 mm from the front surface of the upper table to prevent collision with the door.

7. The refrigerator of claim 1, wherein the bracket includes a pair of first coupling holes through which screws are received to couple the bracket to the upper table.

8. The refrigerator of claim 7, wherein the upper table includes a pair of second coupling holes in which the screws received through the pair of first coupling holes are respectively received.

9. The refrigerator of claim 8, wherein the upper table includes a pair of support ribs respectively formed by the pair of second coupling holes and configured to support the bracket while the bracket is coupled to the upper table.

10. The refrigerator of claim 1, wherein the bracket includes a plurality of anti-movement ribs in contact with the upper table, the plurality of anti-movement ribs preventing the bracket from being moved during opening and closing of the door.

11. The refrigerator of claim 1, wherein a diameter of the opening is 0.1 mm larger than a diameter of the lens.

* * * * *